United States Patent [19]

Bordaz et al.

[11] Patent Number: 4,998,672

[45] Date of Patent: Mar. 12, 1991

[54] MANUALLY CONTROLLED SPRAYING INSTALLATION AND SPRAYER

[75] Inventors: Pascal Bordaz, Domene; Laurent Giraud, Le Touvet; Alain Monnier; Eric Prus, both of Grenoble, all of France

[73] Assignee: Sames S.A., Meylan, France

[21] Appl. No.: 507,108

[22] Filed: Apr. 9, 1990

Related U.S. Application Data

[63] Continuation of Ser. No. 221,047, Jul. 19, 1988, abandoned.

[30] Foreign Application Priority Data

Jul. 19, 1988 [FR] France ..... 87 10213

[51] Int. Cl.[5] ..... B05G 7/12

[52] U.S. Cl. ..... 239/585

[58] Field of Search ..... 417/43, 426; 251/121, 251/205; 239/413, 416.4, 416.5, 61, 63, 525-527; 222/51

[56] References Cited

U.S. PATENT DOCUMENTS

| | | | |
|---|---|---|---|
| 1,626,096 | 4/1927 | Reichenbach | 239/527 X |
| 1,720,389 | 7/1929 | Binks . | |
| 2,685,294 | 8/1954 | Gold et al. | 251/121 |
| 2,959,358 | 11/1960 | Vork | 239/527 X |
| 3,029,062 | 4/1962 | Thomas | 251/121 |
| 3,416,730 | 12/1968 | Perry | 239/61 |
| 4,019,653 | 4/1977 | Sherer et al. | 239/61 X |
| 4,294,277 | 10/1981 | Szeliga | 137/101.19 |
| 4,568,248 | 2/1986 | Harders | 417/43 |

FOREIGN PATENT DOCUMENTS

| | | | |
|---|---|---|---|
| 529316 | 11/1940 | United Kingdom | 239/417.3 |
| 1105265 | 3/1958 | United Kingdom . | |

*Primary Examiner*—Andres Kashnikow
*Assistant Examiner*—Kevin Weldon
*Attorney, Agent, or Firm*—Sandler, Greenblum & Bernstein

[57] ABSTRACT

An installation for spraying a coating product includes a manually controlled pneumatic sprayer operated by a trigger. The compressed air flowrate is varied according to the position of the trigger. The coating product feed system can include a gear pump driven at variable speed by a motor controlled by an electric signal representing the position of the trigger.

14 Claims, 2 Drawing Sheets

MANUALLY CONTROLLED SPRAYING INSTALLATION AND SPRAYER

This application is a continuation of application Ser. No. 221,047, filed July 19, 1988 now abandoned.

BACKGROUND OF THE INVENTION

1. Technical Field of the Invention

The invention concerns a manually controlled installation for spraying coating product, meaning an installation employing a manually controlled pneumatic sprayer including a trigger controlling both the flowrate of the coating product (paint) and the degree to which the valve controlling the input of air to spray this product is open.

The invention is more particularly directed to improvements to secure better control of the flowrates of air and coating product. It finds a particularly advantageous application in installations employing two-component paints or varnishes (typically a base and a hardener) whereby the volumetric ratio between the two-components is better controlled under all circumstances.

2. Description of the Prior Art

A conventional manually controlled paint spraying installation comprises at least one pneumatic sprayer including a trigger and connected to a paint feed line and to a compressed air feed line. The paint is "atomized" and propelled by the air towards the object to be painted. The user controls the jet of sprayed paint by pressing the trigger to a greater or lesser extent. The paint passes through a valve controlled by the trigger. The valve exercises a proportional action, meaning that it is arranged in such a way that the flowrate of the valve is a function of the degree to which the trigger is depressed. The air feed control valve, also controlled by the trigger, is of the "on-off" type, however; this means that the air flowrate remains virtually constant whatever the paint flowrate. It has been found that this particular feature of known sprayers can in itself be prejudicial to good spraying. It can be deleterious to use too much air for a relatively low paint flowrate. It has been found that the excess air tends to dry the paint before it reaches the object to be painted, which can result in a bad finish. One object of the invention is to resolve this problem.

SUMMARY OF THE INVENTION

In one aspect, the invention consists in an installation for spraying a coating product, including at least one manually controlled pneumatic sprayer, a trigger on said at least one sprayer, means connected to said at least one sprayer to feed coating product to be sprayed thereto, a compressed air supply and means for progressively varying the flowrate of said compressed air responsive to the position of said trigger.

The invention is further concerned with another improvement enabling the paint flowrate to be controlled more accurately, by using a gear pump in the paint feed circuit. The invention therefore also consists in an installation as defined above in which the coating product feed means include a gear pump, a motor adapted to drive said gear pump at variable speed, means for producing an electric signal representing the position of said trigger and control means for said motor responsive to said signal.

The installation advantageously includes a sensor in said signal producing means responsive to the flowrate of said compressed air.

Finally, it is particularly beneficial to apply the principles of the invention to the use of a two-component coating product in that a gear pump may be provided in each paint feed circuit and the pumps may be controlled so that their flowrates are maintained under all circumstances in a predetermined ratio corresponding to the optimum proportions of the two components.

The invention therefore also consists in an installation as defined hereinabove adapted to spray a two-component coating product and including a mixer for said two components of said product on an input side of said at least one sprayer and having two inlets, one for each component, and an outlet connected to said at least one sprayer, a respective feed circuit for each component, a respective gear pump in each feed circuit on the input side of said mixer, respective motors adapted to drive said gear pumps at variable speed and respective control means for said motors adapted to maintain the flowrates of said two components in a predetermined ratio.

In another aspect, the invention consists in a pneumatic sprayer adapted to be driven by compressed air, including a trigger and means for progressively varying the compressed air flowrate responsive to the position of said trigger.

The invention will be better understood and other advantages of the invention will emerge more clearly from the following description given by way of non-limiting example only with reference to the appended diagrammatic drawings.

DESCRIPTION OF THE PREFERRED EMBODIMENTS

Figure 1:
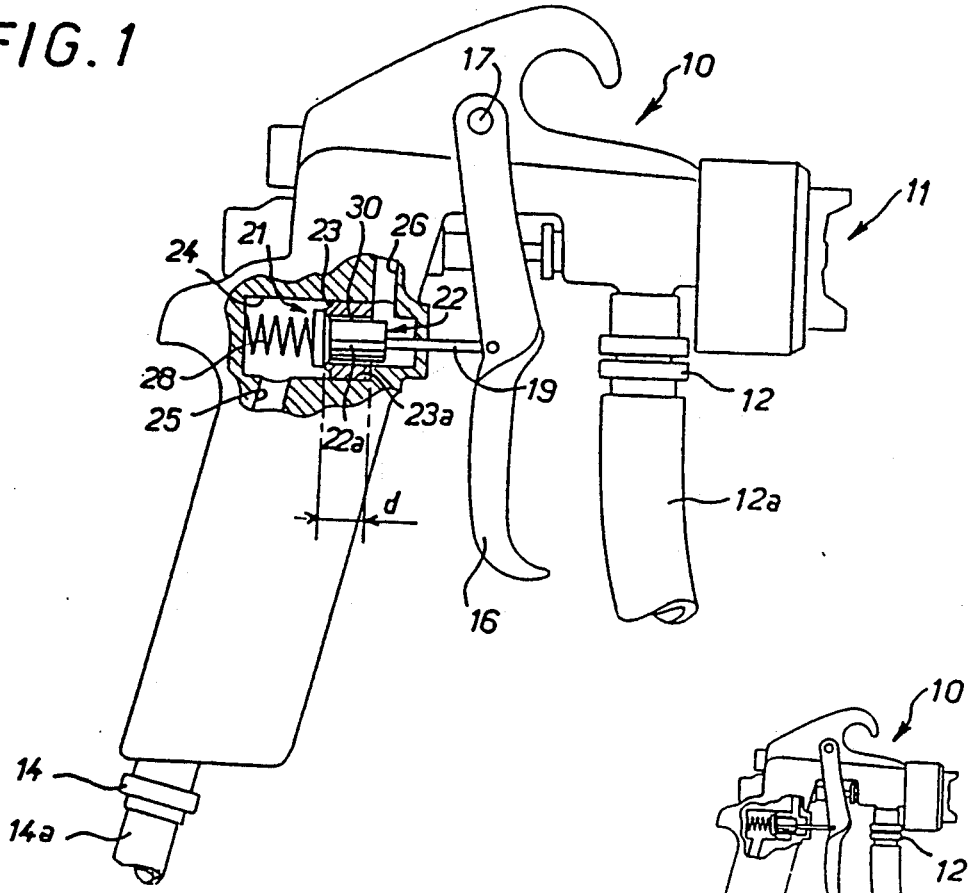
FIG. 1 is a partially cut away view of a paint sprayer in accordance with the invention.

With particular reference to FIG. 1, a manually operated paint sprayer 10 includes in the conventional way a spray nozzle 11, a connector 12 connected to a paint feed line **12*a* and a connector 14 connected to a compressed air feed line 14*a*. A trigger 16 is articulated at 17 to the body of the sprayer. It is coupled to the plunger of a proportional valve (not shown) controlling the paint flowrate. It is also coupled by an articulated rod 19 to means for progressively varying the flowrate of the compressed air. These comprise a flowrate adjuster valve 21 including an obturator member 22 movable relative to a seat 23 defined within a chamber 24 between an inlet 25 connected to the connector 14 and an outlet 26 connected to the spraying means. The rod 19 is attached to the obturator member 22 and a spring 28 in the chamber 24 urges the obturator member towards the seat 23**, that is to say towards the closed position of the valve.

The progressive adjustment of the air flowrate according to the position of the trigger is obtained by throttling the air over a variable axial distance in an annular passage 30 defined between the obturator member and the seat. To this end the obturator member comprises a core member 22a which is substantially cylindrical and the seat 23 comprises or is extended by a conduit portion 23a which is substantially cylindrical and the diameter of which is greater than that of the core member 22a. The variable length annular passage 30 is defined between the core member 22a and the conduit portion 23a. Acted on by the rod 19 and the spring 28, the core member moves axially within the conduit portion. The length d of the latter corresponds substantially to the travel of the trigger. Consequently, the head loss occasioned by throttling the air in the passage 30 and the resulting spraying air flowrate depend on the position of the trigger. The air flowrate and paint flowrate therefore vary according to the position of the trigger. In particular, for a low flowrate of paint there will be a low consumption of air, avoiding drying of the paint by the excess air.

Figure 2:
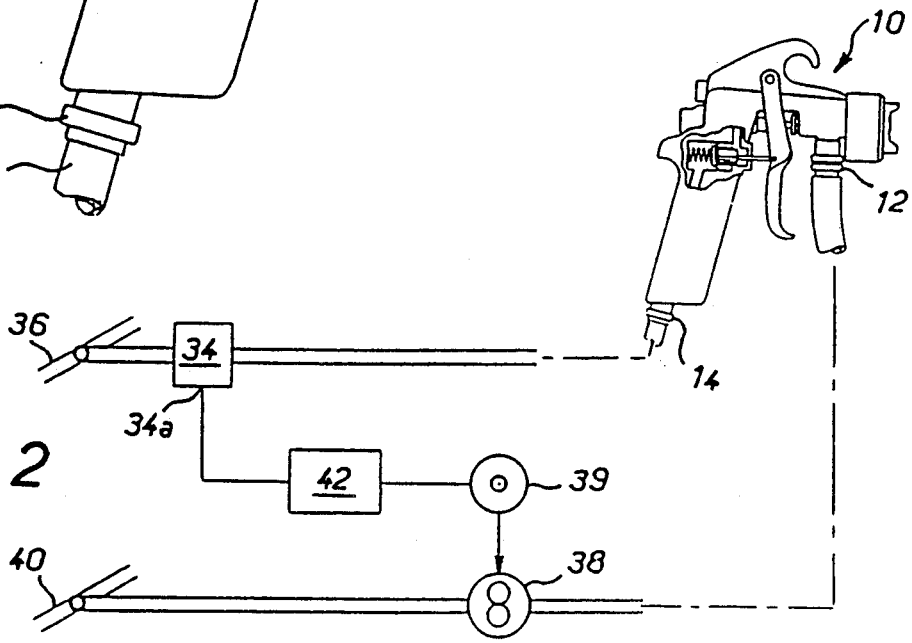
FIG. 2 is a schematic showing a paint spraying installation in accordance with the invention.

FIG. 2 shows in its simplest form an installation for spraying coating product using the sprayer from FIG. 1. However, this can be further simplified in that, as will be explained later, the paint flowrate control valve no longer needs to be of the proportional control type. In this installation the air feed means connected to the connector 14 include an air flowrate sensor 34 for measuring the spraying air flowrate as determined by the valve 21. This sensor, of any known type, is inserted between the compressed air supply, here represented by the line 36, and the sprayer 10. The sensor could of course be integrated into the sprayer. The sensor delivers at its output 34a an electrical signal representing the air flowrate and consequently the degree to which the trigger is depressed. The coating product feed means include a gear pump 38 driven at variable speed by a motor 39. The pump is inserted between a paint line 40 and the connector 12. The motor 39 is energized by control means 42 (a current amplifier, for example) responsive to an electric signal representing the position of the trigger 16. This signal is produced at the electrical output 34a of the air flowrate sensor 34.

Figure 3:
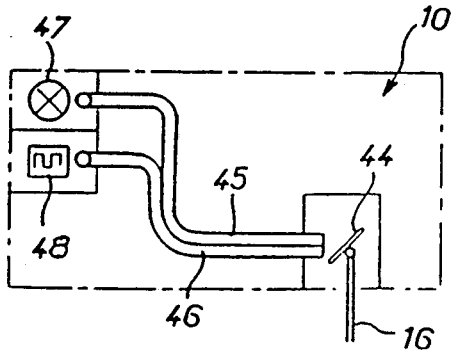
FIG. 3 is a detailed view of an alternative version of the FIG. 1 sprayer.

In the alternative embodiment of FIG. 3 opto-electric means are used to produce the signal representing the position of the trigger 16. The latter is mechanically coupled to a pivoting reflective member 44 included in an optical fiber circuit 45, 46 established between a light source 47 and an opto-electric sensor 48. The latter is part of the means for producing the electric signal representing the position of the trigger. The electric signal output of the sensor 48 can therefore be connected to the control means 42 in the same way as the output 34a of the air flowrate sensor 34.

The FIG. 2 embodiment is preferable because it has the additional advantage of rendering the pump also responsive to any fluctuations in the air pressure. In other words, in the event of malfunctioning of the air feed means, the paint flowrate can be modified automatically to maintain a substantially constant air-paint mix. This avoids the spraying of excess paint and therefore any risk of paint running.

Figure 4:
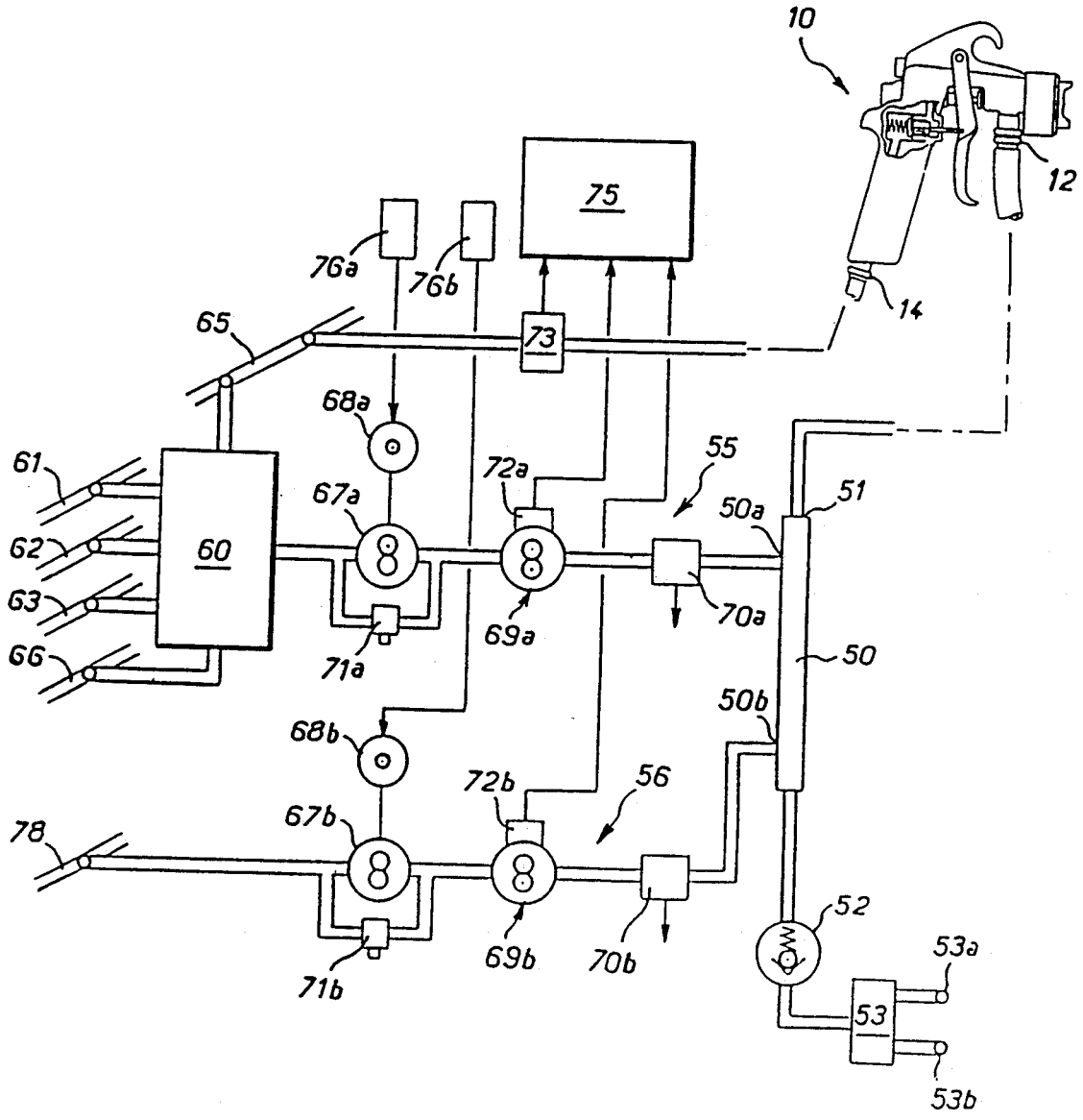
FIG. 4 is a schematic showing another installation in accordance with the invention, adapted to use of a two-component paint.

FIG. 4 shows a particularly beneficial application of the invention to the use of a two-component coating product, in particular a paint obtained by mixing a colored base and a hardener. The same sprayer as described above is used again. It is desirable to mix the components continuously, as the mixture is consumed. The installation therefore includes a mixer 50 on the input side of the sprayer 10. The mixer has two inlets 50a, 50b, one for each of the two components, and an outlet 51 connected to the connector 12. The mixer is also connected via a check valve 52 to a cleaning unit 53 known in itself including a solvent inlet 53a and a compressed air inlet 53b. The installation comprises a paint (or base) feed circuit 55 and a hardener feed circuit 56. The outlet from the circuit 55 is connected to the inlet 50a of the mixer and the outlet of the circuit 56 is connected to inlet 50b of the mixer. The circuit 55 is connected to a color change unit 60 known in itself connected to several paint or base feed lines for different colors 61 -63, to an air feed line 65 and to a solvent feed line 66. The circuit 55 therefore comprises in succession between the color change unit 60 and the mixer: a gear pump 67a driven at variable speed by an electric motor 68a, a flowrate sensor 69a and a purge valve 70a. A safety valve 71a is connected in parallel with the pump. The flowrate sensor 69a is advantageously of the "gear" type, meaning that its mechanical part is very similar structurally to a gear pump. One of the gears of this sensor is coupled to an inductive transducer 72a the electric output of which delivers a signal representing the liquid flowrate in the circuit 55. The hardener circuit 56 is in all respects comparable with the circuit 55. It is connected to a hardener line 78 and includes, interconnected in the same way, a gear pump 67b driven by a motor 68b, a flowrate sensor 69b with its transducer 72b, a safety valve 71b and a purge valve 70b.

The compressed air feed means are similar to those of FIG. 2 and therefore comprise an air flowrate sensor 73 connected between the line 65 and the connector 14. A computer 75 of any type, as available through normal commercial channels, for example, receives the output signals from the flowrate sensors 69a and 69b and from the air flowrate sensors 73 (delivering a signal representing the position of the trigger) and delivers control signals to two current amplifiers 76a, 76b respectively feeding the motors 68a, 68b. The computer 75 forms part of the control means for the motors 68a, 68b. It is programmed to maintain the flowrates of the two components in the circuit 55 and 56 in a predetermined ratio.

The system is set so that when the trigger is very slightly depressed a low flowrate of spraying air is established before paint is admitted into the sprayer. The plunger of the paint inlet valve is still closed at this time. The pump is enabled to operate only above a particular air flowrate for which it is certain that the valve plunger is effectively open. All these operating details can easily be processed by the computer 75. Likewise, on closing the valve, a minimum flowrate threshold is set prior to which the pump is stopped. The opening and closing thresholds may be different. It is also possible to stop the pump before closing the plunger, if the air flowrate sensor has a relatively slow response.

What is claimed:

1. Installation for spraying a coating product, including at least one manually controlled pneumatic sprayer, a positionable trigger on said at least one sprayer, variable flow rate means connected to said at least one sprayer, for feeding coating product to be sprayed thereby, a compressed air supply connected to said at least one sprayer for supplying air thereto, means for establishing the flowrate of said compressed air in response to the position of said trigger, a sensor responsive to the flowrate of said compressed air, and control means responsive to said sensor and operatively coupled to said variable flow rate means for causing the rate at which coating product is fed to said at least one sprayer to be substantially proportional to the rate at which said compressed air is supplied thereto.

2. Installation according to claim 1, wherein said at least one sprayer includes an air flowrate adjuster valve including a member mechanically coupled to said trigger, a substantially cylindrical core member and a seat having a larger diameter, substantially cylindrical conduit portion defining, with said core member, an annular passage the length of which can be varied according to the position of said trigger.

3. Installation according to claim 2, wherein said core member is coupled to said trigger and movable axially within said conduit portion.

4. Installation according to claim 2, wherein the means to feed coating product include a gear pump, and a motor adapted to drive said gear pump at variable speed in response to said sensor.

5. Installation according to claim 4, wherein said signal producing means include an opto-electric sensor and further comprising an optical fiber circuit including a light source, a pivoted reflective member to which said trigger is mechanically coupled and said opto-electric sensor.

6. Installation according to claim 1, adapted to spray a two-component coating product and including a mixer for said two components of said product on an input side of said at least one sprayer and having two inlets, one for each component, and an outlet connected to said at least one sprayer, a respective feed circuit for each component, a respective gear pump in each feed circuit on the input side of said mixer, respective motors adapted to drive said gear pumps at variable speed and respective control means for said motors adapted to maintain the flowrates of said two components in a predetermined ratio.

7. Installation according to claim 6, wherein said control means include computation means adapted to receive a signal representing the position of said trigger and signals representing the respective flowrates of said two components on an output side of said gear pumps and adapted to produce respective control signals for said motors.

8. Installation according to claim 7, further comprising respective sensors responsive to the flowrates of said two components disposed between the respective gear pump and said mixer and adapted to deliver corresponding electric signals to said computation means.

9. Installation according to claim 8, wherein said sensors are gear type sensors.

10. Apparatus for spraying, comprising:

(a) a spray nozzle;

(b) a pump for delivering a first coating product to said nozzle; and (c) flow rate control means including a manually actuatable trigger for selectively connecting a compressed air supply to said nozzle, said control means being constructed and arranged so that actuation of said trigger effects the flow of air from said supply and the flow of said first product to said nozzle which mixes the air and the product into a mixture that is sprayed from the nozzle;

(d) said control means including an air flow sensor for sensing the rate of flow of air to said nozzle, and pump control means responsive to said air flow sensor for controlling the operation of said pump such that the flow rate of said first product is substantially proportional to the flow rate of air.

11. Apparatus according to claim 10 wherein said control means includes a first coating product flow sensor for sensing the rate of flow of said first product to said nozzle, and means responsive to said first coating product flow sensor for controlling said control means.

12. Apparatus according to claim 10 including:

(a) a mixer interposed between said pump sand said nozzle for receiving said first coating product before the latter is delivered to said nozzle;

(b) a second pump for delivering a second coating product to said mixer wherein the first and second products mix before being delivered to said nozzle; and (c) second pump control means responsive to said air flow sensor for controlling the operation of said second pump.

13. Apparatus according to claim 12 wherein said control means includes a first coating product flow sensor for sensing the rate of flow of said first product to said nozzle, and means responsive to said first coating product flow sensor for controlling the operation of said pump.

14. Apparatus according to claim 13 including:

(a) a mixer interposed between said pump and said nozzle for receiving said first coating product before the latter is delivered to said nozzle;

(b) a second pump for delivering a second coating product to said mixer wherein the first and second products mix before being delivered to said nozzle; and (c) second pump control means responsive to said air flow sensor for controlling the operation of said second pump.

* * * * *

UNITED STATES PATENT AND TRADEMARK OFFICE

CERTIFICATE OF CORRECTION

PATENT NO. : 4,998,672

DATED : March 12, 1991

INVENTOR(S) : Bordaz, et al

It is certified that error appears in the above-identified patent and that said Letters Patent is hereby corrected as shown below:

On the cover, line [30], change "Jul. 19, 1988" to --- Jul. 20, 1987 ---.
At column 1, line 22, after "two" delete --- - ---.
At column 6, line 24 (claim 12, line 2), change "sand" to ---and---.

Signed and Sealed this

Tenth Day of August, 1993

*Attest:*

*Attesting Officer*

Michael K. Kirk

MICHAEL K. KIRK

*Acting Commissioner of Patents and Trademarks*